US007867027B2

(12) United States Patent
Sakaguchi et al.

(10) Patent No.: US 7,867,027 B2
(45) Date of Patent: Jan. 11, 2011

(54) COAXIAL CABLE CONNECTOR AND COAXIAL CABLE CONNECTION UNIT

(75) Inventors: Tadahisa Sakaguchi, Shizuoka-ken (JP); Tsutomu Takayama, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 12/177,744

(22) Filed: Jul. 22, 2008

(65) Prior Publication Data

US 2009/0035991 A1 Feb. 5, 2009

(30) Foreign Application Priority Data

Jul. 30, 2007 (JP) ..... P2007-197242

(51) Int. Cl.
*H01R 9/05* (2006.01)

(52) U.S. Cl. ..... 439/585; 439/878

(58) Field of Classification Search ..... 439/585, 439/584, 877, 878
See application file for complete search history.

(56) References Cited

U.S. PATENT DOCUMENTS 6,206,727 B1 * 3/2001 Aoyama et al. ..... 439/585
6,966,796 B2 * 11/2005 Abe et al. ..... 439/585
7,140,914 B2 * 11/2006 Kojima ..... 439/585
7,160,150 B2 * 1/2007 Annequin ..... 439/585
2007/0264873 A1 * 11/2007 Kakuta ..... 439/585

FOREIGN PATENT DOCUMENTS

JP 11-74036 3/1999
JP 11-144776 5/1999

* cited by examiner

*Primary Examiner*—Hlen Vu
(74) *Attorney, Agent, or Firm*—Finnegan, Henderson, Farabow, Garrett & Dunner, L.L.P.

(57) ABSTRACT

A coaxial cable connector includes: a pair of first crimp pieces; and a pair of second crimp pieces. Into the pair of first crimp pieces, an insulating inner sheath and at least a part of a braided wire, which are exposed from an insulating outer sheath, are inserted. The pair of second crimp pieces are located on outsides of the pair of first crimp pieces, and are crimped so as to surround the pair of first crimp pieces. Moreover, the pair of first crimp pieces are formed into a shape that is along inner walls of the pair of second crimp pieces.

6 Claims, 4 Drawing Sheets

COAXIAL CABLE CONNECTOR AND COAXIAL CABLE CONNECTION UNIT

CROSS REFERENCE TO RELATED APPLICATION

This application is based upon and claims the benefit of priority from Japanese Patent Application No. 2007-197242 filed on Jul. 30, 2007, the entire contents of which are incorporated herein by reference.

BACKGROUND OF THE INVENTION

1. Field of the Invention

The present invention relates to a coaxial cable connector and a coaxial cable connection unit.

2. Description of the Related Art

A coaxial cable heretofore known includes: a core wire; an insulating inner sheath that covers the core wire across a longitudinal direction; a braided wire that wraps the insulating inner sheath across the longitudinal direction; and an insulating outer sheath that covers the braided wire across the longitudinal direction. Moreover, there has been known a coaxial cable connector including: first crimp pieces which enter between the insulating inner sheath and the braided wire; and second crimp pieces which are provided on outsides of the first crimp pieces and crimp the coaxial cable from an outside of the braided wire. In this coaxial cable connector, the first crimp pieces are formed into a structure in which tip ends are bent inward so that the first crimp pieces concerned can be facilitated to enter between the insulating inner sheath and the braided wire.

In accordance with the coaxial cable connector as described above, the first crimp pieces enter between the insulating inner sheath and the braided wire. Specifically, a part of the braided wire is sandwiched between the first crimp pieces and the second crimp pieces. Accordingly, even if the insulating inner sheath is shrunk by heat, electrical connection of the braided wire is maintained regardless of such shrinkage of the insulating inner sheath. Specifically, in the case where the first crimp pieces are not present, when the insulating inner sheath is shrunk by the heat, the braided wire separates from the second crimp pieces, and the electrical connection of the braided wire comes not to be maintained. However, in the above-described coaxial cable connector, the first crimp pieces enter between the insulating inner sheath and the braided wire, and accordingly, even if the shrinkage occurs, the braided wire keeps on contacting at least the first crimp pieces, and the electrical connection of the braided wire is maintained (refer to Japanese Patent Laid-Open No. H11-144776 (published in 1999) and Japanese Patent Laid-Open No. H11-74036 (published in 1999)).

SUMMARY OF THE INVENTION

However, in each of the coaxial cable connectors described in Japanese Patent Laid-Open No. H11-144776 and Japanese Patent Laid-Open No. H11-74036, since the tip ends of the first crimp pieces are bent inward, the braided wire is prone to enter into the outsides of the first crimp pieces, and the braided wire sandwiched between the first crimp pieces and the second crimp pieces is increased. In the case where an amount of the braided wire is increased, for example, in such a case of providing a double-layered braided wire, the braided wire enters much into the outsides of the first crimp pieces, the first crimp pieces fall inward to a large extent at the time of a crimping operation. In such a way, a distance between the core wire and the first crimp pieces or a distance between the core wire and the braided wire is shortened, whereby a possibility to cause a short circuit therebetween by the fact that both of them contact each other is increased.

The present invention has been made in order to solve the conventional problem as described above. It is an object of the present invention to provide a coaxial cable connector and a coaxial cable connection unit, which are capable of reducing the possibility of the short circuit at the time of the crimping operation while maintaining the electrical connection of the braided wire.

A coaxial cable connector of the present invention electrically connects thereto a coaxial cable having: a core wire; an insulating inner sheath that covers a circumference of the core wire; a braided wire that wraps a circumference of the insulating inner sheath; and an insulating outer sheath that covers a circumference of the braided wire. The coaxial cable connector includes: a pair of first crimp pieces into which the insulating inner sheath and at least a part of the braided wire are inserted; and a pair of second crimp pieces which are located on outsides of the pair of first crimp pieces and crimp the pair of first crimp pieces in a surrounding manner. The pair of first crimp pieces are formed into a shape that is along inner walls of the pair of second crimp pieces. The coaxial cable is connected to the coaxial cable connector in a state where the core wire is partially exposed in a longitudinal direction from the insulating inner sheath that covers the circumference of the core wire, and where the insulating inner sheath and the braided wire that wraps the circumference of the insulating inner sheath are partially exposed in the longitudinal direction from the insulating outer sheath that covers the circumference of the braided wire.

Moreover, in the coaxial cable connector of the present invention, it is preferable that, on tip ends, the pair of first crimp pieces have tapered surfaces inclined from inside surfaces thereof toward outside surfaces thereof.

Moreover, in the coaxial cable connector of the present invention, it is preferable that the pair of first crimp pieces be connected to each other on a base end thereof opposite to the tip ends, and be formed into a substantially circular shape in cross section in a state of being connected to each other.

Moreover, in the coaxial cable connector of the present invention, it is preferable that, in the pair of second crimp pieces, one thereof overlap other in a state after a crimping operation is performed therefor.

Moreover, in the coaxial cable connector of the present invention, it is preferable that, in the pair of second crimp pieces, one thereof be formed to be longer than other is.

Moreover, a coaxial cable connection unit of the present invention includes: a coaxial cable, in which a core wire is partially exposed in a longitudinal direction from an insulating inner sheath that covers a circumference of the core wire, and a braided wire that wraps a circumference of the insulating inner sheath is partially exposed in the longitudinal direction from an insulating outer sheath that covers the braided wire; and a coaxial connector that electrically connects to the coaxial wire. Furthermore, the coaxial cable connector has: a pair of first crimp pieces inserted into at least a partial space between the insulating inner sheath exposed from the insulating outer sheath and the braided wire exposed therefrom; and a pair of second crimp pieces which are located on outsides of the pair of first crimp pieces and are crimped so as to surround the pair of first crimp pieces, and the pair of first crimp pieces are formed into a shape that is along inner walls of the pair of second crimp pieces.

Moreover, in the coaxial cable connection unit of the present invention, it is preferable that the braided wire be subjected to tin plating.

In accordance with the coaxial cable connector of the present invention, the pair of first crimp pieces ifs formed into the shape that is along the inner walls of the pair of second crimp pieces. As described above, the pair of first crimp pieces are formed into the shape that is along the inner walls of the pair of second crimp pieces without being bent inward. Accordingly, when the insulating inner sheath and at least a part of the braided wire are inserted between the pair of first crimp pieces, the amount of the braided wire located on the outsides of the pair of first crimp pieces is decreased. In such a way, even if the braided wire is one with a large amount, such as with a double-layered structure, the amount of the braided wire located on the outsides of the first crimp pieces is reduced, and an amount by which the pair of first crimp pieces fall inward is reduced. In addition, though the amount of the braided wire located on the outsides of the pair of first crimp pieces is decreased, the braided wire is not entirely located in the insides of the first crimp pieces, whereby the electrical connection thereof is also maintained. Hence, the possibility of the short circuit can be reduced at the time of the crimping operation while maintaining the electrical connection of the braided wire.

Moreover, on the tip ends, the pair of first crimp pieces have the tapered surfaces inclined from the inside surfaces toward the outside surfaces. Accordingly, even if the first crimp pieces fall inward at the time of the crimping operation, a distance between the pair of first crimp pieces is widened owing to the existence of the tapered surfaces, and the first crimp pieces become less likely to squash the insulating inner sheath. Hence, such a circumstance can be restricted, where the distance between the core wire and the braided wire and the distance between the core wire and the first crimp pieces become short.

Moreover, the pair of first crimp pieces are connected to each other on the base end thereof opposite to the tip ends, and are formed into the substantially circular shape in cross section in the state of being connected to each other. Here, for example, in the case where the pair of first crimp pieces are formed into a recessed shape in cross section, the first crimp pieces are prone to be bent from corner portions of the recessed shape and to fall inward to a large extent at the time of the crimping operation. On the other hand, the pair of first crimp pieces are formed into the circular shape in cross section, and accordingly, at the time of the crimping operation, it is less likely that only such specific spots are bent, and the pair of first crimp pieces will be bent gently as a whole. Hence, such a circumstance can be restricted, where such an inward falling amount is increased.

Moreover, in the pair of second crimp pieces, one thereof overlaps the other in the state after the crimping operation is performed therefor. Accordingly, even if the amount of the braided wire is large, since one of the second crimp pieces covers the other like a lid, a possibility that the braided wire may stick out of the pair of second crimp pieces can be reduced.

Moreover, in the pair of second crimp pieces, since one thereof is formed to be longer than the other is, one thereof becomes likely to overlap the other in the state after the crimping operation, and the possibility that the braided wire may stick out of the pair of second crimp pieces can be reduced.

In accordance with the coaxial cable connection unit of the present invention, the pair of first crimp pieces is formed into the shape that is along the inner walls of the pair of second crimp pieces. As described above, since the pair of first crimp pieces are not bent inward, in the case where the insulating inner sheath and at least a part of the braided wire are inserted between the pair of first crimp pieces, the amount of the braided wire located in insides of the pair of first crimp pieces is increased. In such a way, in the case where a coaxial cable in which the braided wire has the double-layered structure is crimped, since the amount of the braided wire located in the insides of the pair of first crimp pieces is large, a falling amount by which the pair of first crimp pieces fall inward is decreased. In addition, though the amount of the braided wire located on the outsides of the pair of first crimp pieces is decreased, the braided wire is not entirely located in the insides of the first crimp pieces, whereby the electrical connection thereof is also maintained. Hence, the possibility of the short circuit can be reduced at the time of the crimping operation while maintaining the electrical connection of the braided wire.

Moreover, since the braided wire is subjected to the tin plating, electrical conductivity thereof is enhanced, thus making it possible to facilitate the maintenance of the electrical connection of the braided wire.

DESCRIPTION OF THE PREFERRED EMBODIMENT

Figure 1:
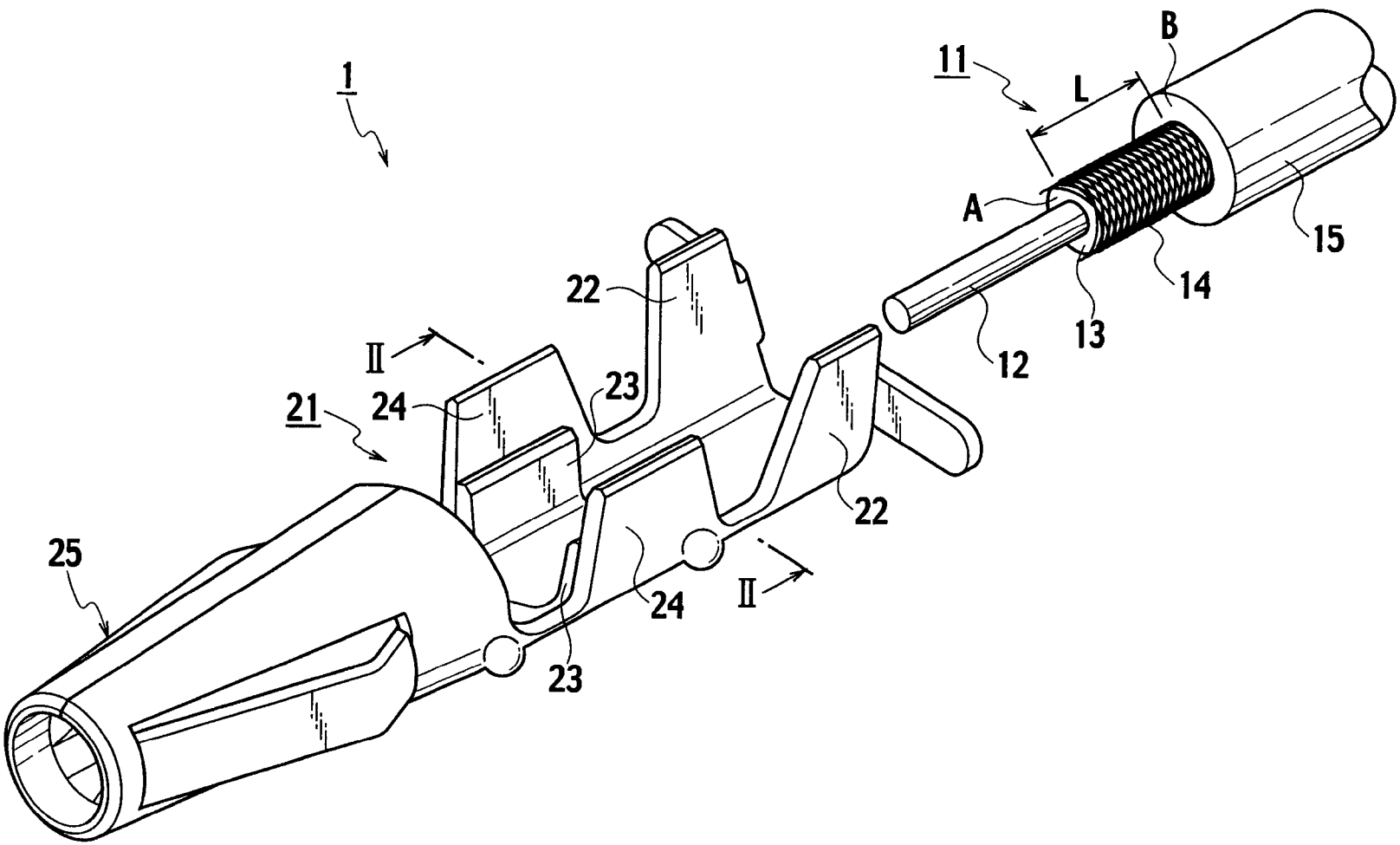
FIG. 1 is a perspective view showing an exterior appearance of a coaxial cable connection unit according to an embodiment of the present invention.

A description will be made below of an embodiment of the present invention with reference to the drawings. As shown in FIG. 1, a coaxial cable connection unit 1 includes: a coaxial cable 11; and a coaxial cable connector 21.

The coaxial cable 11 is a type of electric wires for use in telecommunication, and is composed of a core wire 12, an insulating inner sheath 13, a braided wire 14, and an insulating outer sheath 15. The core wire 12 is a line to transmit a signal and the like, and the line is formed of a material such as copper. The insulating inner sheath 13 is an insulator that covers a circumference of the core wire 12 across a longitudinal direction. The braided wire 14 is a conductor formed into a net shape by braiding thin conductive wires, and is provided across the longitudinal direction so as to wrap a circumference of the insulating inner sheath 13. This braided wire 14 has a role to shield noise, and plays a role as a shield layer. Moreover, the braided wire 14 is subjected to tin plating. The insulating outer sheath 15 is an insulator formed of a material such as polyethylene, and plays a role as a protection sheath for the respective layers provided in an inner circumferential side thereof.

Moreover, in the case of being crimped and connected to the coaxial cable connector 21, the coaxial cable 11 is subjected to end treatment. This end treatment will be described specifically. In the case where the coaxial cable 11 is crimped and connected to the coaxial cable connector 21, the insulating inner sheath 13, the braided wire 14 and the insulating outer sheath 15 are removed from the coaxial cable 11, and as shown in FIG. 1, the core wire 12 is partially exposed from the insulating inner sheath 13 in the longitudinal direction. Moreover, the insulating outer sheath 15 is further removed from the coaxial cable 11 at a spot B apart by a predetermined distance L from a spot A where the insulating inner sheath 13, the braided wire 14 and the insulating outer sheath 15 are removed, and the insulating inner sheath 13 and the braided wire 14 are partially exposed from the insulating outer sheath 15 in the longitudinal direction.

The coaxial cable connector 21 is a component to be electrically connected to the coaxial cable 11, and is composed of a pair of fixing pieces 22, a pair of first crimp pieces 23, a pair of second crimp pieces 24, and a jack portion 25. The pair of fixing pieces 22 are metal pieces which are provided on a rear end side (in a direction oriented toward the insulating outer sheath 15 from the core wire 12 exposed by being subjected to the end treatment) of the coaxial cable connector 21, and crimp the coaxial cable 11 from an outside of the insulating outer sheath 15. Next, a description will be made of the pair of first crimp pieces 23 and the pair of second crimp pieces 24 with reference to FIG. 2.

Figure 2:
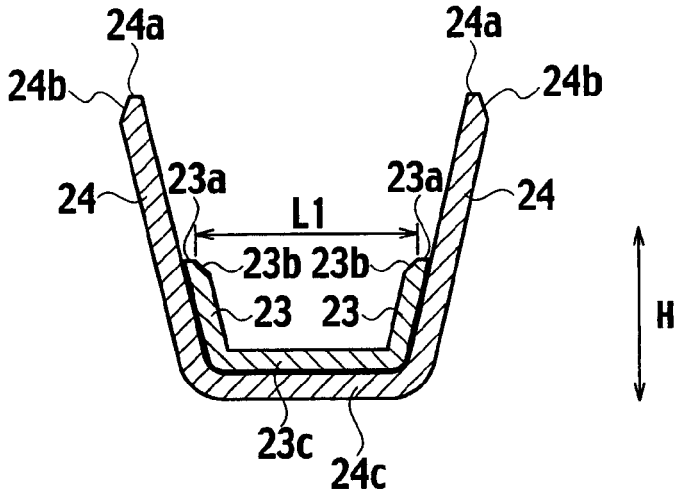
FIG. 2 is a cross-sectional view along a line II-II of FIG. 1.

FIG. 2 is a cross-sectional view along a line II-II of FIG. 1. The pair of first crimp pieces 23 are metal pieces formed so as to correspond to the braided wire 14 exposed from the insulating outer sheath 15. More specifically, the pair of first crimp pieces 23 are metal pieces in which a distance L1 between tip ends 23*a* is made larger than an outer diameter of the braided wire 14, that is, an inner diameter of the insulating outer sheath 15, and desirably, are metal pieces in which the distance L1 is made slightly larger than the outer diameter of the braided wire 14. Moreover, the pair of first crimp pieces 23 are connected to each other on a base end 23*c*, and cross sections (cross sections perpendicular to the longitudinal direction of the coaxial cable 11) thereof are formed into a substantially recessed shape. Furthermore, on tip ends, the pair of first crimp pieces 23 have tapered surfaces 23*b* inclined from inside surfaces thereof toward outside surfaces thereof.

The pair of second crimp pieces 24 are metal pieces which are located on outsides of the first crimp pieces 23 and are formed so as to be higher than the pair of first crimp pieces 23 in a height direction H (direction perpendicular to the longitudinal direction of the coaxial wire 11 and perpendicular to a direction where the pair of first crimp pieces 23 face to each other) and so as to surround the first crimp pieces 23. Moreover, on tip ends 24*a*, the pair of second crimp pieces 24 have tapered surfaces 24*b* inclined from outside surfaces thereof toward inside surfaces thereof. Furthermore, the pair of second crimp pieces 24 are connected to each other on a base end 24*c*, and cross sections thereof are formed into a substantially recessed shape in a similar way to the pair of first crimp pieces 23. As described above, the pair of first crimp pieces 23 are formed into a shape that is along inner walls of the pair of second crimp pieces 24.

FIG. 1 will be referred to one more time. The jack portion 25 is a portion to be fitted to a plug (not shown), and is formed into a cylindrical shape. Moreover, in the jack portion 25, a core wire connection portion (not shown) is provided in a cylindrical inner portion thereof. The core wire 12 and the core wire connection portion are electrically connected to each other, whereby the coaxial cable 11 and the coaxial cable connector 21 are electrically connected to each other.

Next, a description will be made of a method for crimping and connecting the coaxial cable 11 to the coaxial cable connector 21. First, an operator or the like performs the end treatment for the coaxial cable 11 as shown in FIG. 1. Specifically, the operator or the like peels off the insulating inner sheath 13, the braided wire 14 and the insulating outer sheath 15, and exposes the core wire 12 from the insulating inner sheath 13. Moreover, the operator or the like peels off the insulating outer sheath 15, and exposes the insulating inner sheath 13 and the braided wire 14 from the insulating outer sheath 15.

Figure 3:
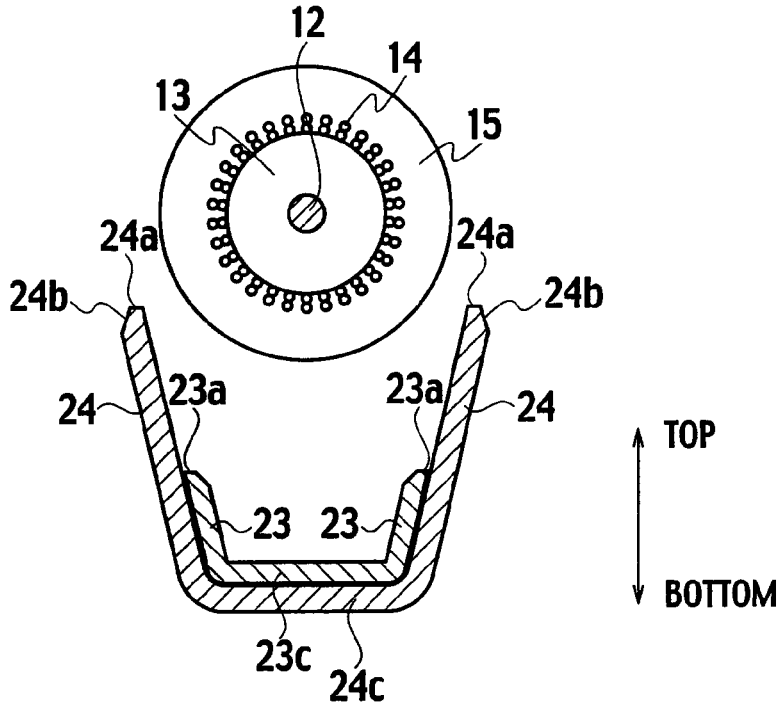
FIG. 3 is a first cross-sectional view showing a state of crimping and connecting a coaxial cable 11 to a coaxial cable connector.
Figure 4:
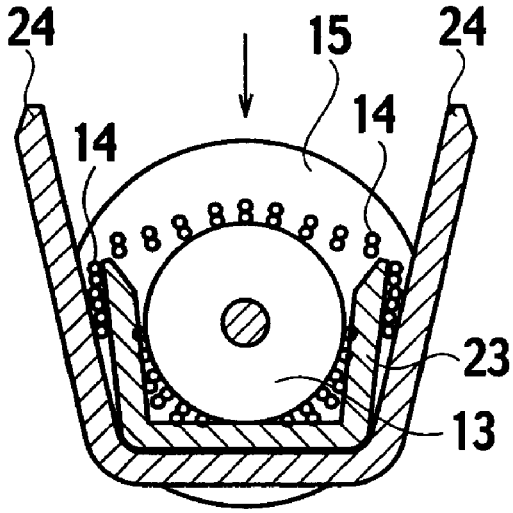
FIG. 4 is a second cross-sectional view showing the state of crimping and connecting the coaxial cable 11 to the coaxial cable connector.
Figure 5:
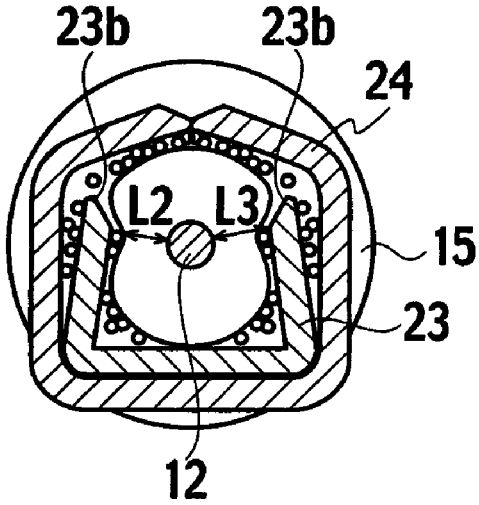
FIG. 5 is a third cross-sectional view showing the state of crimping and connecting the coaxial cable 11 to the coaxial cable connector.

FIGS. 3 to 5 are cross-sectional views showing a state of crimping and connecting the coaxial cable 11 to the coaxial cable connector 21. After performing the end treatment, as shown in FIG. 3, the operator or the like places the coaxial cable 11 above the pair of first crimp pieces 23 and the pair of second crimp pieces 24, that is, above in a direction oriented from the base end 23*c* of the pair of first crimp pieces 24 toward the tip ends 23*a* while taking the height direction as an axis. At this time, the operator or the like places a spot, in which the insulating inner sheath 13 and the braided wire 14 are exposed, above the pair of first crimp pieces 23 and the pair of second crimp pieces 24.

Then, as shown in FIG. 4, the operator or the like moves the coaxial cable 11 downward, and pushes the coaxial cable 11 into a space between the pair of first crimp pieces 23. In such a way, the pair of first crimp pieces 23 enter between the insulating inner sheath 13 and the braided wire 14, and at least a part of the braided wire 14 enters between the pair of first crimp pieces 23 and the pair of second crimp pieces 24. Next, the operator or the like crimps the second crimp pieces 24. In such a way, as shown in FIG. 5, the insulating inner sheath 13 is fixed so as to be compressed. Thereafter, the operator or the like crimps the pair of fixing pieces 22 so that the insulating outer sheath 15 can be covered therewith. By procedures described above, the crimping and the connection are ended.

Here, in the coaxial cable connector 21 according to this embodiment, the pair of first crimp pieces 23 are formed into the shape that is along the pair of second crimp pieces 24. Accordingly, in the case of pushing the same coaxial cable 11 into the conventional coaxial cable connector and the coaxial cable connector 21 according to this embodiment, an amount of the braided wire 14 that enters between the pair of first crimp pieces 23 and the pair of second crimp pieces 24 is reduced in the coaxial cable connector 21 according to this embodiment than in the conventional coaxial cable connector.

Figure 6:
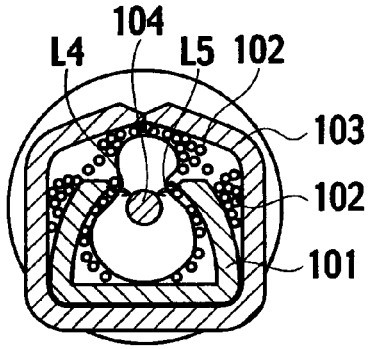
FIG. 6 is a cross-sectional view showing a comparative example.

FIG. 6 is a cross-sectional view showing a comparative example. In the case where tip ends of a pair of first crimp pieces 101 are bent inward, as shown in FIG. 6, an amount of a braided wire 102 that enters into outsides of the pair of first crimp pieces 101 is increased. Accordingly, in the case of crimping second crimp pieces 103, the pair of first crimp pieces 101 fall inward to a large extent in a manner of being pushed into the braided wire 102. In such a way, a distance L4 between a core wire 104 and the braided wire 102 and a distance L5 between the core wire 104 and the first crimp pieces 101 are shortened, whereby a possibility of a short circuit occurs.

On the other hand, in the coaxial cable connector 21 according to this embodiment, as shown in FIG. 5, the amount of the braided wire 14 located on the outsides of the pair of first crimp pieces 23 is decreased. In such a way, a falling amount by which the pair of first crimp pieces 23 fall inward in the case of crimping the coaxial cable 11 is decreased. In particular, such an effect becomes significant in the case where the braided wire 14 is one with a large amount, such as with a double-layered structure. Specifically, a distance L2 between the core wire 12 and the braided wire 14 becomes longer than the distance L4 shown in FIG. 6. Moreover, a distance L3 between the core wire 12 and the first crimp piece 23 becomes longer than the distance L5 shown in FIG. 6. In such a way, in the coaxial cable connector 21 according to this embodiment, the possibility of the short circuit is reduced.

Moreover, in the coaxial cable connector 21 according to this embodiment, though the amount of the braided wire 14 located on the outsides of the pair of first crimp pieces 23 is decreased, the braided wire 14 is not entirely located in insides of the first crimp pieces 23, whereby electrical connection thereof is also maintained.

In addition, the pair of first crimp pieces 23 have the tapered surfaces 23*b* inclined from the inside surfaces toward the outside surfaces. Accordingly, even if the first crimp pieces 23 fall inward at the time of such a crimping operation, a distance between the pair of first crimp pieces 23 is widened owing to the existence of the tapered surfaces 23*b*, and the first crimp pieces 23 become less likely to squash the insulating inner sheath 13. In such a way, the distance L2 between the core wire 12 and the braided wire 14 and the distance L3 between the core wire 12 and the first crimp pieces 23 are further widened.

As described above, in accordance with the coaxial cable connector 21 and the coaxial cable connection unit 1 according to the first embodiment, the pair of first crimp pieces 23 are formed into the shape that is along the inner walls of the pair of second crimp pieces 24. As described above, the pair of first crimp pieces 23 are formed into the shape that is along the inner walls of the pair of second crimp pieces 24 without being bent inward. Accordingly, when the pair of first crimp pieces 23 are inserted between the insulating inner sheath 13 and the braided wire 14, the amount of the braided wire 14 located on the outsides of the pair of first crimp pieces 23 is decreased. In such a way, even if the braided wire 14 is one with a large amount, such as with a double-layered structure, the amount of the braided wire 14 located on the outsides of the first crimp pieces 23 is reduced, and the amount by which the pair of first crimp pieces 23 fall inward is reduced. In addition, though the amount of the braided wire 14 located on the outsides of the pair of first crimp pieces 23 is decreased, the braided wire 14 is not entirely located in the insides of the first crimp pieces 23, whereby the electrical connection thereof is also maintained. Hence, the possibility of the short circuit can be reduced at the time of the crimping operation while maintaining the electrical connection of the braided wire 14.

Moreover, on the tip ends, the pair of first crimp pieces 23 have the tapered surfaces 23*b* inclined from the inside surfaces toward the outside surfaces. Accordingly, even if the first crimp pieces 23 fall inward at the time of the crimping operation, the distance between the pair of first crimp pieces 23 is widened owing to the existence of the tapered surfaces 23*b*, and the first crimp pieces 23 become less likely to squash the insulating inner sheath 13. Hence, such a circumstance can be restricted, where the distance L2 between the core wire 12 and the braided wire 14 and the distance L3 between the core wire 12 and the first crimp pieces 23 become short.

Moreover, since the braided wire 14 is subjected to the tin plating, electrical conductivity thereof is enhanced, thus making it possible to facilitate the maintenance of the electrical connection of the braided wire 14.

Next, a description will be made of a second embodiment according to the present invention. A coaxial cable connector 21 and a coaxial cable connection unit 1 according to the second embodiment are similar to those of the first embodiment; however, are partially different therefrom in configurations. A description will be made below of different points from the first embodiment.

Figure 7:
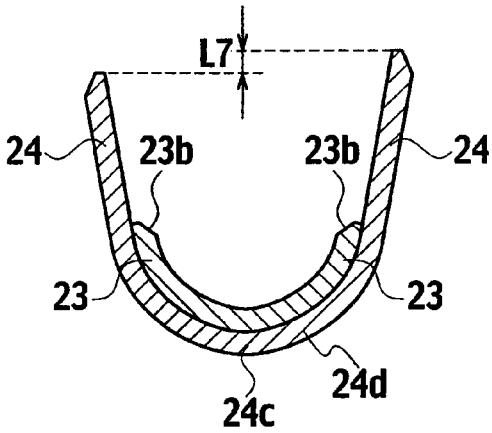
FIG. 7 is a cross-sectional view of a main portion of a coaxial cable connector according to a second embodiment.

FIG. 7 is a cross-sectional view of a main portion of the coaxial cable connector 21 according to the second embodiment. As shown in FIG. 7, in the coaxial cable connector 21 according to the second embodiment, a pair of first crimp pieces 23 are formed into a substantially circular shape in cross section (cross section perpendicular to the longitudinal direction of the coaxial cable 11). Moreover, in a similar way, on a base end 23*c*, a pair of second crimp pieces 24 also have a portion 24*d* that is substantially circular in cross section. Furthermore, with regard to the pair of second crimp pieces 24, one thereof is formed to be longer than the other is. Specifically, with regard to the pair of second crimp pieces 24, one thereof is formed to be higher than the other is by a distance L7.

Figure 8:
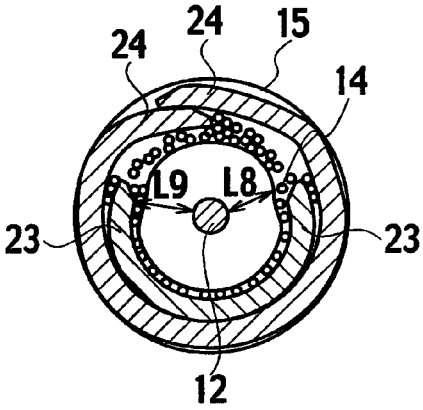
FIG. 8 is a cross-sectional view showing a state after crimping the coaxial cable connector according to the second embodiment.

FIG. 8 is a cross-sectional view showing a state after crimping the coaxial cable connector 21 according to the second embodiment. As shown in FIG. 8, in the coaxial cable connector 21 according to the second embodiment, each of a distance L8 between the core wire 12 and the braided wire 14 and a distance L9 between the core wire 12 and the pair of first crimp pieces 23 is larger than the corresponding distance of the first embodiment.

Specifically, in the first embodiment, since the pair of first crimp pieces 23 are formed into the recessed shape in cross section, the first crimp pieces 23 are prone to be bent from corner portions of the recessed shape and to fall inward to a large extent at the time of the crimping operation. On the other hand, in the second embodiment, the pair of first crimp pieces 23 are formed into the substantially circular shape in cross section, and accordingly, at the time of the crimping operation, it is less likely that only such specific spots are bent, and the pair of first crimp pieces 23 will be bent gently as a whole, whereby such an inward falling amount is reduced.

Moreover, in the coaxial cable connector 21 according to the second embodiment, since one of the pair of second crimp pieces 24 is formed to be higher than the other is, one overlaps the other after the crimping operation is performed therefor. In such a way, one of the second crimp pieces 24 covers the other like a lid, and the braided wire 14 becomes less likely to stick out of the pair of second crimp pieces 24.

As described above, in accordance with the coaxial cable connector 21 and the coaxial cable connection unit 1 in accordance with the second embodiment, the possibility of the short circuit can be reduced at the time of the crimping operation while maintaining the electrical connection of the braided wire 14 in a similar way to the first embodiment. Moreover, by the tapered surfaces 23*b*, such a circumstance can be restricted, where the distance L8 between the core wire 12 and the braided wire 14 and the distance L9 between the core wire 12 and the pair of first crimp pieces 23 become short. Moreover, since the braided wire 14 is subjected to the tin plating, the electrical conductivity thereof is enhanced, thus making it possible to facilitate the maintenance of the electrical connection of the braided wire 14.

Moreover, in accordance with the second embodiment, the pair of first crimp pieces 23 are formed into the substantially circular shape in cross section. Here, for example, in the case where the pair of first crimp pieces 23 are formed into the recessed shape in cross section, the pair of first crimp pieces 23 are prone to be bent from the corner portions of the recessed shape and to fall inward to a large extent at the time of the crimping operation. On the other hand, in the second embodiment, the pair of first crimp pieces 23 are formed into the circular shape in cross section, and accordingly, at the time of the crimping operation, it is less likely that only the specific spots are bent, and the pair of first crimp pieces 23 will be bent gently as a whole. Hence, such a circumstance can be restricted, where the inward falling amount is increased. Note that, in this case, it is desirable that, on the base end 23*c*, the pair of second crimp pieces 24 have a portion 24*d* that is substantially circular in cross section. In such a way, also with regard to the pair of second crimp pieces 24, the portion 24*d* that is substantially circular in cross section is bent gently, and such a circumstance can be restricted, where a space wrapped by the pair of second crimp pieces 24 after the crimping operation is narrowed.

Moreover, in the pair of second crimp pieces 24, one overlaps the other in a state after the crimping operation. Therefore, even if the amount of the braided wire 14 is large, since one of the second crimp pieces 24 covers the other like a lid, a possibility that the braided wire 14 may stick out of the pair of second crimp pieces 24 can be reduced.

Furthermore, with regard to the pair of second crimp pieces 24, one thereof is formed to be longer than the other is. Therefore, one of the pair of second crimp pieces 24 becomes likely to overlap the other in the state after the crimping operation, whereby the possibility that the braided wire 14 may stick out of the pair of second crimp pieces 24 can be reduced.

Although the description has been made above of the present invention based on the embodiments, the present invention is not limited to the above-described embodiments, and may be modified within the scope without departing from the spirit of the present invention. For example, though the above-described embodiments have been described while taking as an example the case where the braided wire 14 is one with the double-layered structure, the present invention is not limited to this, and the braided wire 14 is one with a single-layered structure or with a triple or more-layered structure.

Moreover, in the above-described embodiments, the first crimp pieces with the recessed shape in cross section and the circular shape in cross section have been described as examples of the first crimp pieces 23; however, the present invention is not limited to this, and the shape of the pair of first crimp pieces 23 may be other than the above, for example, such as a triangular shape in cross section.

Furthermore, in the above-described embodiments, the description has been made of the example where the distance L1 between the tip ends of the pair of first crimp pieces 23 is longer than the outer diameter of the braided wire 14; however, the present invention is not limited to this, and the distance L1 may be slightly shorter than the outer diameter of the braided wire 14. Note that it is more desirable that the distance L1 be longer than the outer diameter of the braided wire 14 since insertion force to push the coaxial cable 11 into the space between the pair of first crimp pieces 23 is decreased.

Furthermore, in the above-described embodiments, the description has been made of the example where both of the first crimp pieces 23, which make a pair, include the tapered surfaces 23*b*; however, the present invention is not limited to this, and the tapered surface 23*b* may be formed only on one of both thereof.

Furthermore, in the above-described embodiments, the description has been made of the example where the pair of first crimp pieces 23 contact the inner walls of the pair of second crimp pieces 24 in the state before the crimping operation; however, the present invention is not limited to this, and the pair of first crimp pieces 23 may separate from the pair of second crimp pieces 24 in the state before the crimping operation.

What is claimed is:

1. A coaxial cable connector that electrically connects thereto a coaxial cable including: a core wire; an insulating inner sheath that covers a circumference of the core wire; a braided wire that wraps a circumference of the insulating inner sheath; and an insulating outer sheath that covers a circumference of the braided wire, the coaxial cable connector comprising:

a pair of first crimp pieces into which the insulating inner sheath and at least a part of the braided wire are inserted wherein the pair of first crimp pieces have tapered surfaces on tip ends of inside surfaces thereof, the tapered surfaces being inclined from the inside surfaces thereof toward outside surfaces thereof; and a pair of second crimp pieces which are located on outsides of the pair of first crimp pieces and crimp the pair of first crimp pieces in a surrounding manner, wherein the pair of second crimp pieces have tapered surfaces on tip ends that are arranged opposite to the tip ends of the pair of first crimp pieces, the tapered surfaces being inclined from outside surfaces of the pair of second crimp pieces toward inside surfaces thereof, wherein the pair of first crimp pieces are formed into a shape that is along inner walls of the pair of second crimp pieces, and the coaxial cable is connected to the coaxial cable connector in a state where the core wire is partially exposed in a longitudinal direction from the insulating inner sheath covering the circumference of the core wire, and where the insulating inner sheath and the braided wire wrapping the circumference of the insulating inner sheath are partially exposed in the longitudinal direction from the insulating outer sheath covering the circumference of the braided wire, wherein the pair of first crimp pieces are connected to each other on a base end thereof opposite to the tip ends and an entire of the pair of first crimp pieces and the base end abut against an interior wall of the connection base end of the pair of second crimp pieces and the pair of second crimp pieces before the crimp pieces are crimped.

2. The coaxial cable connector according to claim 1, wherein the pair of first crimp pieces are connected to each other on the base end and are formed into a substantially circular shape in cross section in a state of being connected to each other.

3. The coaxial cable connector according to claim 1, wherein in the pair of second crimp pieces, one thereof overlaps another in a state after a crimping operation is performed therefor.

4. The coaxial cable connector according to claim 3, wherein in the pair of second crimp pieces, one thereof is formed to be longer than the other is.

5. A coaxial cable connection unit, comprising:

a coaxial cable, in which a core wire is partially exposed in a longitudinal direction from an insulating inner sheath that covers a circumference of the core wire, and a braided wire that wraps a circumference of the insulating inner sheath is partially exposed in the longitudinal direction from an insulating outer sheath that covers the braided wire; and a coaxial connector that electrically connects to the coaxial wire, including: a pair of first crimp pieces inserted into at least a partial space between the insulating inner sheath exposed from the insulating outer sheath and the braided wire exposed therefrom; and a pair of second crimp pieces which are located on outsides of the pair of first crimp pieces and are crimped to surround the pair of first crimp pieces, wherein the pair of first crimp pieces are formed into a shape that is along inner walls of the pair of second crimp pieces, wherein the pair of first crimp pieces have tapered surfaces on tip ends of inside surfaces thereof, the tapered surfaces being inclined from the inside surfaces thereof toward outside surfaces thereof, wherein the pair of second crimp pieces have tapered surfaces on tip ends that are arranged opposite to the tip ends of the pair of first crimp pieces, the tapered surfaces being inclined from outside surfaces of the pair of second crimp pieces toward inside surfaces thereof, and wherein the pair of first crimp pieces are connected to each other on a base end thereof opposite to the tip ends and an entire of the pair of first crimp pieces and the base end abut against an interior wall of the connection base end of the pair of second crimp pieces and the pair of second crimp pieces before the crimp pieces are crimped.

6. The coaxial cable connection unit according to claim 5, wherein the braided wire is subjected to tin plating.

* * * * *